US008574019B2

(12) United States Patent
Kuriyagawa et al.

(10) Patent No.: US 8,574,019 B2
(45) Date of Patent: Nov. 5, 2013

(54) OUTBOARD MOTOR CONTROL APPARATUS

(75) Inventors: Koji Kuriyagawa, Saitama (JP); Hajime Yoshimura, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 155 days.

(21) Appl. No.: 13/114,713

(22) Filed: May 24, 2011

(65) Prior Publication Data

US 2011/0294371 A1 Dec. 1, 2011

(30) Foreign Application Priority Data

May 28, 2010 (JP) ..... 2010-123287

(51) Int. Cl.
*B63H 21/21* (2006.01)
*B63H 21/22* (2006.01)

(52) U.S. Cl.
USPC ..... 440/1; 440/86

(58) Field of Classification Search
USPC ..... 440/1, 86, 87
See application file for complete search history.

(56) References Cited

U.S. PATENT DOCUMENTS 4,323,354 A * 4/1982 Blanchard ..... 440/75
6,102,755 A * 8/2000 Hoshiba ..... 440/1
6,582,259 B1 * 6/2003 Mansson et al. ..... 440/75
6,942,530 B1 * 9/2005 Hall et al. ..... 440/1
7,909,670 B2 3/2011 Suzuki et al.
2009/0209151 A1 8/2009 Suzuki et al.

FOREIGN PATENT DOCUMENTS

JP 2009-166723 A 7/2009
JP 2009-190671 A 8/2009
JP 2009-190672 A 8/2009

* cited by examiner

*Primary Examiner* — Stephen Avila

(74) *Attorney, Agent, or Firm* — Carrier Blackman & Associates, P.C.; Joseph P. Carrier; Fulchand P. Shende

(57) ABSTRACT

In an apparatus for controlling operation of an outboard motor having an internal combustion engine to power a propeller, and a transmission selectively changeable in gear position to establish speeds including at least a first speed and a second speed and transmitting power of the engine to the propeller with a gear ratio determined by established speed, it is configured to determine whether the transmission is in a reverse position, and control operation of the transmission to change the gear position from the second speed to the first speed when the second speed is selected and the transmission is determined to be in the reverse position. With this, it becomes possible to prevent the thrust of the boat from decreasing.

8 Claims, 6 Drawing Sheets

OUTBOARD MOTOR CONTROL APPARATUS

BACKGROUND OF THE INVENTION

1. Technical Field

This invention relates to an outboard motor control apparatus, particularly to an apparatus for controlling an outboard motor with a transmission.

2. Background Art

In recent years, there is proposed a technique for an outboard motor having a transmission interposed at a power transmission shaft between an internal combustion engine and a propeller to transmit an output of the engine to the propeller, which technique is configured to select a gear position (ratio) of the transmission from the first and second speeds based on an engine speed and a manipulation amount of a throttle lever, change the engine output in speed with the selected gear position and transmit it to the propeller, as taught, for example, by Japanese Laid-Open Patent Application No. 2009-190671. In the reference, also when the boat mounted with the outboard motor is traveled backward, the transmission is selectively changeable in gear position to establish the first or second speed.

SUMMARY OF INVENTION

A propeller of an outboard motor is generally designed to have a shape capable of generating and outputting the thrust most efficiently when it is rotated in a direction making the boat travel forward. Therefore, when the propeller is rotated in a reverse direction making the boat travel backward (specifically, in the case where a transmission is changed to the second speed and the propeller is rotated at high speed), the efficiency worsens, i.e., the thrust of the boat is decreased.

An object of this invention is therefore to overcome the foregoing problem by providing an apparatus for controlling an outboard motor having a transmission, which apparatus can prevent the thrust of the boat from decreasing.

In order to achieve the object, this invention provides in the first aspect an apparatus for controlling operation of an outboard motor adapted to be mounted on a stern of a boat and having an internal combustion engine to power a propeller through a drive shaft and a propeller shaft, and a transmission that is installed at a location between the drive shaft and the propeller shaft, the transmission being selectively changeable in gear position to establish speeds including at least a first speed and a second speed and transmitting power of the engine to the propeller with a gear ratio determined by established speed, comprising: a reverse position determiner adapted to determine whether the transmission is in a reverse position; and a transmission controller adapted to control operation of the transmission to change the gear position from the second speed to the first speed when the second speed is selected and it is determined that the transmission is in the reverse position.

In order to achieve the object, this invention provides in the second aspect a method for controlling operation of an outboard motor adapted to be mounted on a stern of a boat and having an internal combustion engine to power a propeller through a drive shaft and a propeller shaft, a transmission that is installed at a location between the drive shaft and the propeller shaft, the transmission being selectively changeable in gear position to establish speeds including at least a first speed and a second speed and transmitting power of the engine to the propeller with a gear ratio determined by established speed, comprising the steps of: determining whether the transmission is in a reverse position; and controlling operation of the transmission to change the gear position from the second speed to the first speed when the second speed is selected and it is determined that the transmission is in the reverse position.

BRIEF DESCRIPTION OF DRAWINGS

The above and other objects and advantages of the invention will be more apparent from the following description and drawings in which.

DESCRIPTION OF EMBODIMENT

An embodiment of an outboard motor control apparatus according to the invention will now be explained with reference to the attached drawings.

Figure 1:
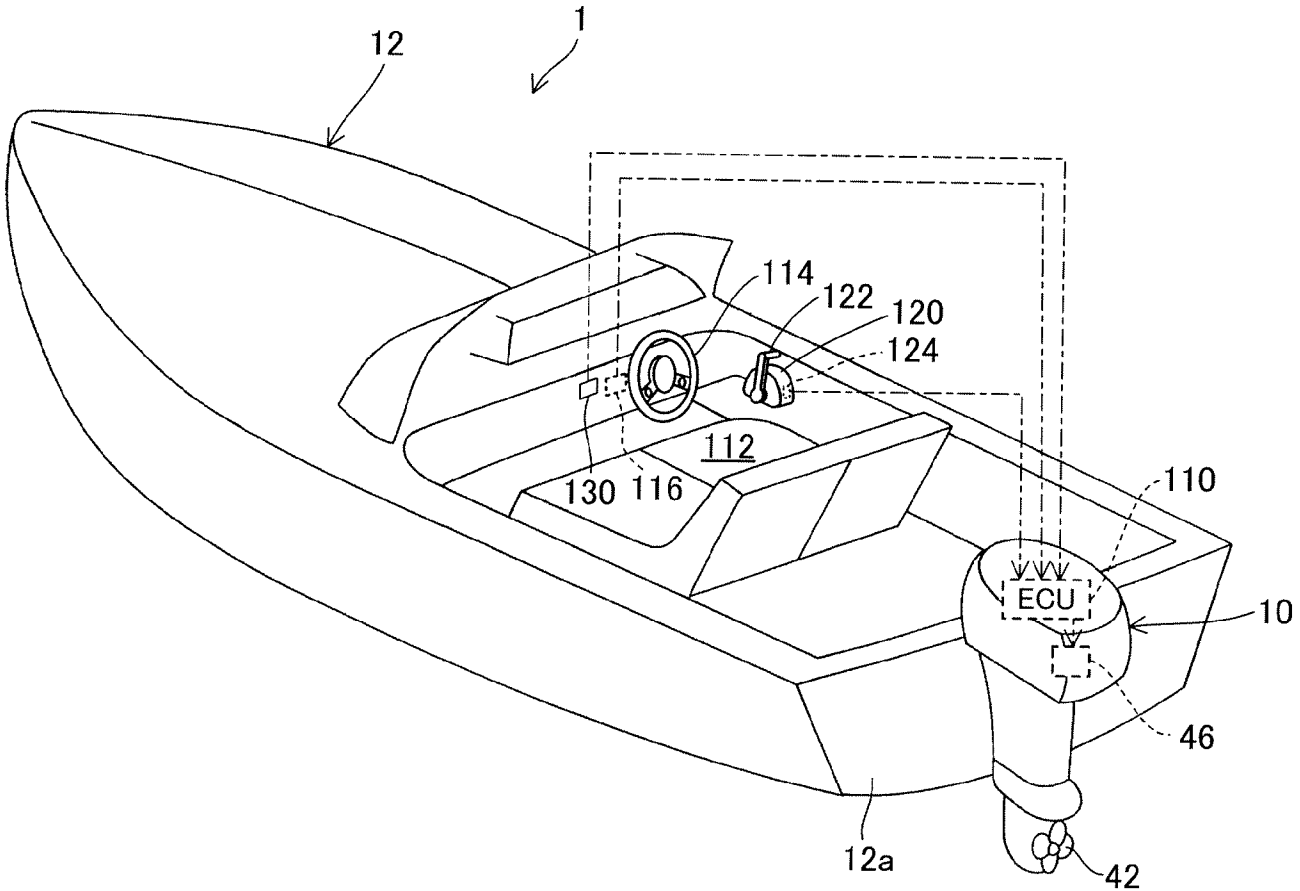
FIG. 1 is an overall schematic view of an outboard motor control apparatus including a boat according to a first embodiment of the invention.
Figure 2:
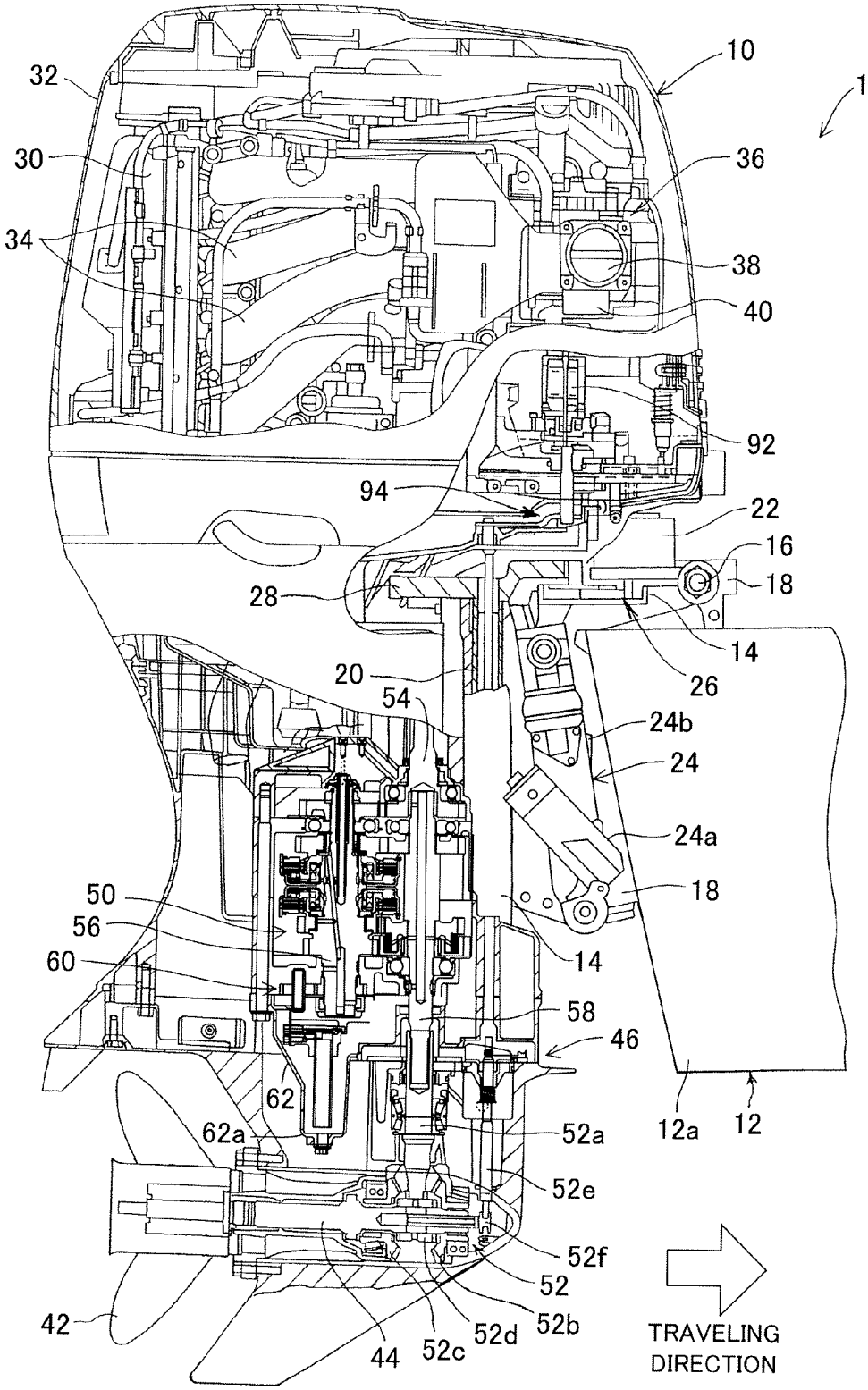
FIG. 2 is an enlarged sectional side view partially showing the outboard motor shown in FIG. 1.

FIG. 1 is an overall schematic view of an outboard motor control apparatus including a boat according to a first embodiment of the invention. FIG. 2 is an enlarged sectional side view partially showing the outboard motor shown in FIG. 1 and FIG. 3 is an enlarged side view of the outboard motor.

Figure 3:
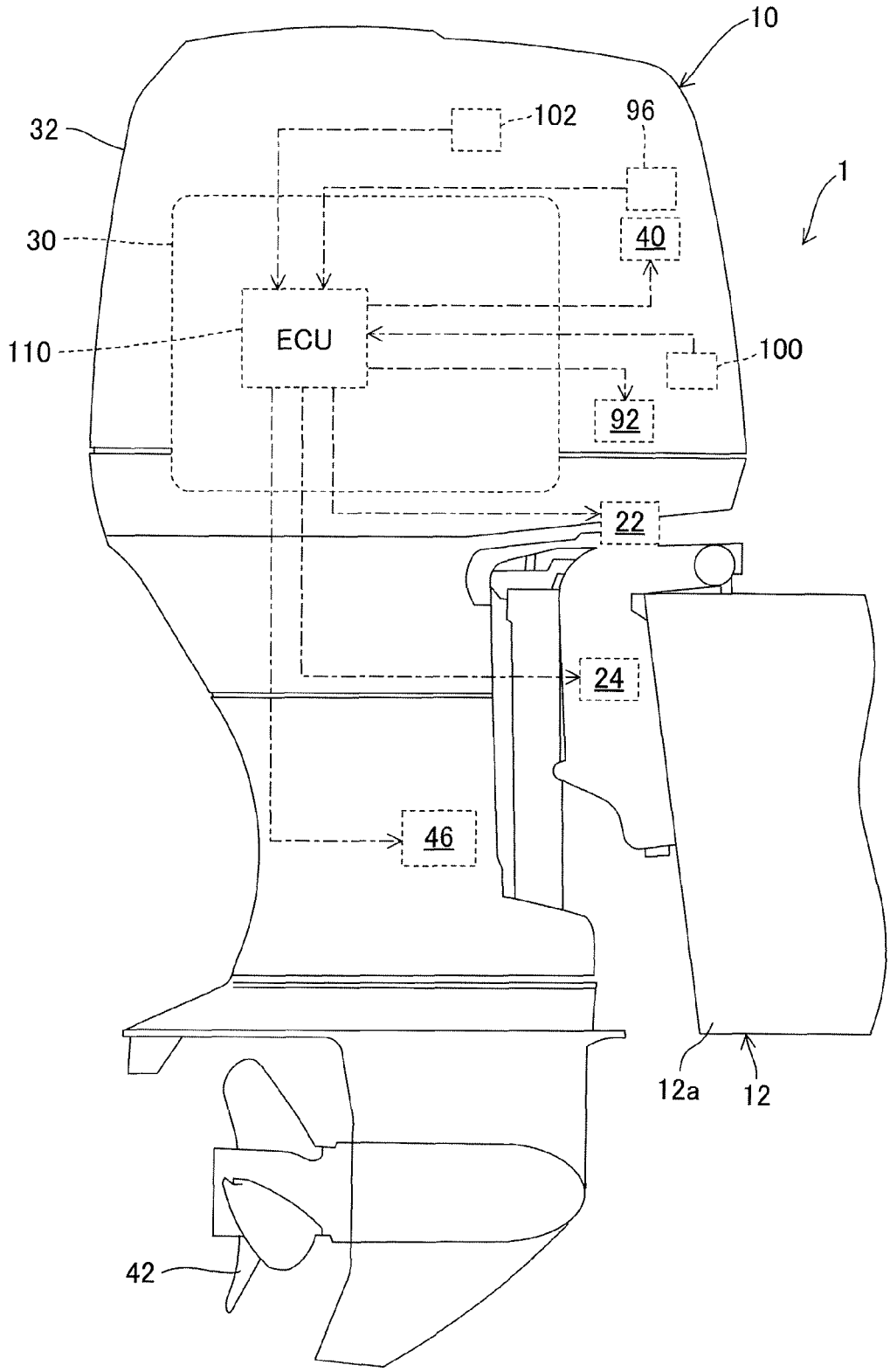
FIG. 3 is an enlarged side view of the outboard motor shown in FIG. 1.

In FIGS. 1 to 3, a symbol 1 indicates a boat or vessel whose hull 12 is mounted with the outboard motor 10. As clearly shown in FIG. 2, the outboard motor 10 is clamped (fastened) to the stern or transom 12*a* of the boat 1, more precisely, to the stern 12*a* of the hull 12 through a swivel case 14, tilting shaft 16 and stern brackets 18.

An electric steering motor (actuator) 22 for operating a shaft 20 which is housed in the swivel case 14 to be rotatable about the vertical axis and a power tilt-trim unit (actuator; hereinafter called the "trim unit") 24 for regulating a tilt angle and trim angle of the outboard motor 10 relative to the boat 1 (i.e., hull 12) by tilting up/down and trimming up/down are installed near the swivel case 14. A rotational output of the steering motor 22 is transmitted to the shaft 20 via a speed reduction gear mechanism 26 and mount frame 28, whereby the outboard motor 10 is steered about the shaft 20 as a steering axis to the right and left directions (steered about the vertical axis).

The trim unit 24 integrally comprises a hydraulic cylinder 24*a* for adjusting the tilt angle and a hydraulic cylinder 24*b* for adjusting the trim angle. In the trim unit 24, the hydraulic cylinders 24*a*, 24*b* are extended/contracted so that the swivel case 14 is rotated about the tilting shaft 16 as a rotational axis, thereby tiling up/down and trimming up/down the outboard motor 10. The hydraulic cylinders 24*a*, 24*b* are connected to a hydraulic circuit (not shown) in the outboard motor 10 and extended/contracted upon being supplied with operating oil therethrough.

An internal combustion engine (hereinafter referred to as the "engine") 30 is disposed in the upper portion of the outboard motor 10. The engine 30 comprises a spark-ignition, water-cooling gasoline engine with a displacement of 2,200 cc. The engine 30 is located above the water surface and covered by an engine cover 32.

An air intake pipe 34 of the engine 30 is connected to a throttle body 36. The throttle body 36 has a throttle valve 38 installed therein and an electric throttle motor (actuator; engine speed controller) 40 for opening and closing the throttle valve 38 is integrally disposed thereto.

The output shaft of the throttle motor 40 is connected to the throttle valve 38 via a speed reduction gear mechanism (not shown). The throttle motor 40 is operated to open and close the throttle valve 38, thereby regulating the flow rate of the air sucked in the engine 30 to control an engine speed NE of the engine 30.

The outboard motor 10 further comprises a propeller shaft (power transmission shaft) 44 that is supported to be rotatable about the horizontal axis and attached with a propeller 42 at its one end to transmit power output of the engine 30 thereto, and a transmission (automatic transmission) 46 that is interposed at a location between the engine 30 and propeller shaft 44 and has a plurality of gear positions, i.e., first, second and third speeds.

The propeller 42 is designed to have a shape capable of generating and outputting the thrust most efficiently (e.g., with taking a shape of blades, pitch, etc., into account) when it is rotated in a direction making the boat 1 travel forward. The transmission 46 comprises a transmission mechanism 50 that is selectively changeable in gear positions and a shift mechanism 52 that can change a shift position among forward, reverse and neutral positions.

Figure 4:
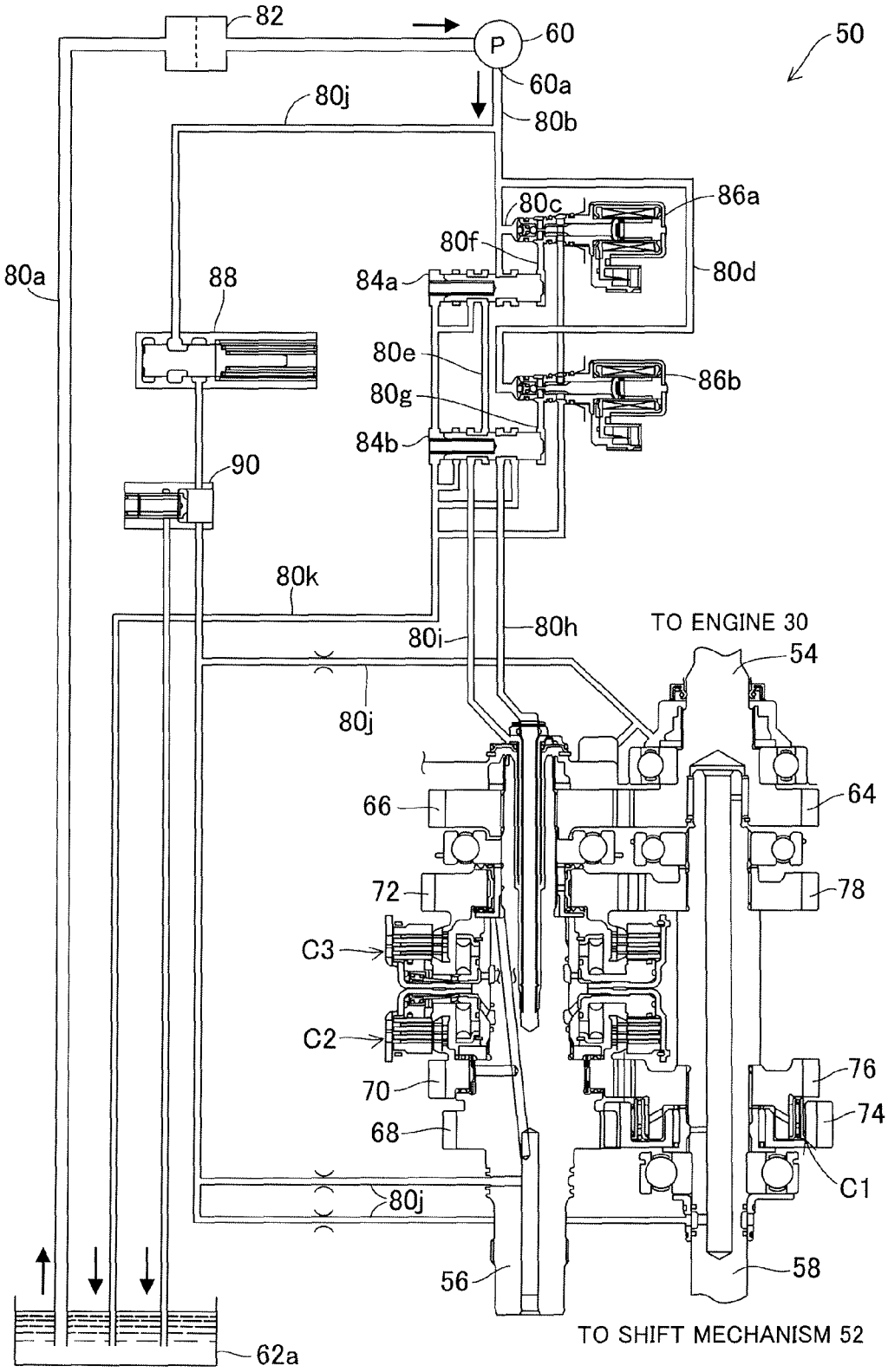
FIG. 4 is a hydraulic circuit diagram schematically showing a hydraulic circuit of a transmission mechanism shown in FIG. 2.

FIG. 4 is a hydraulic circuit diagram schematically showing a hydraulic circuit of the transmission mechanism 50.

As shown in FIGS. 2 and 4, the transmission mechanism 50 comprises a parallel-axis type transmission mechanism with distinct gear positions (ratios), which includes an input shaft (drive shaft) 54 connected to the crankshaft (not shown in the figures) of the engine 30, a countershaft 56 connected to the input shaft 54 through a gear, and a first connecting shaft 58 connected to the countershaft 56 through several gears. Those shafts 54, 56, 58 are installed in parallel.

The countershaft 56 is connected with a hydraulic pump (gear pump; shown in FIGS. 2 and 4) 60 that pumps up the operating oil (lubricating oil) and forwards it to transmission clutches and lubricated portions of the transmission mechanism 50 (explained later). The foregoing shafts 54, 56, 58, hydraulic pump 60 and the like are housed in a case 62 (shown only in FIG. 2). An oil pan 62*a* for receiving the operating oil is formed at the bottom of the case 62.

In the so-configured transmission mechanism 50, the gear installed on the shaft to be rotatable relative thereto is fixed on the shaft through the transmission clutch so that the transmission 46 is selectively changeable in the gear position to establish one of the three speeds (i.e., first to third speeds), and the output of the engine 30 is changed with the gear ratio determined by the established (selected) gear position (speed; gear) and transmitted to the propeller 42 through the shift mechanism 52 and propeller shaft 44. A gear ratio of the gear position (speed) is set to be the highest in the first speed and decreases as the speed changes to second and then third speed.

The further explanation on the transmission mechanism 50 will be made. As clearly shown in FIG. 4, the input shaft 54 is supported with an input primary gear 64. The countershaft 56 is supported with a counter primary gear 66 to be meshed with the input primary gear 64, and also supported with a counter first-speed gear 68, counter second-speed gear 70 and counter third-speed gear 72.

The first connecting shaft 58 is supported with an output first-speed gear 74 to be meshed with the counter first-speed gear 68, an output second-speed gear 76 to be meshed with the counter second-speed gear 70, and an output third-speed gear 78 to be meshed with the counter third-speed gear 72.

In the above configuration, when the output first-speed gear 74 supported to be rotatable relative to the first connecting shaft 58 is brought into a connection with the first connecting shaft 58 through a first-speed clutch C1, the first speed (gear position) is established. The first-speed clutch C1 comprises a one-way clutch. When a second-speed or third-speed hydraulic clutch C2 or C3 (explained later) is supplied with hydraulic pressure so that the second or third speed (gear position) is established and the rotational speed of the first connecting shaft 58 becomes greater than that of the output first-speed gear 74, the first-speed clutch C1 makes the output first-speed gear 74 rotate idly (i.e., rotate without being meshed).

When the counter second-speed gear 70 supported to be rotatable relative to the countershaft 56 is brought into a connection with the countershaft 56 through the second-speed hydraulic clutch (transmission clutch) C2, the second speed (gear position) is established. Further, when the counter third-speed gear 72 supported to be rotatable relative to the countershaft 56 is brought into a connection with the countershaft 56 through the third-speed hydraulic clutch (transmission clutch) C3, the third speed (gear position) is established. The hydraulic clutches C2, C3 connect the gears 70, 72 to the countershaft 56 upon being supplied with the hydraulic pressure, while making the gears 70, 72 rotate idly when the hydraulic pressure is not supplied.

The interconnections between the gears and shafts through the clutches C1, C2, C3 are performed by controlling the hydraulic pressure supplied from the pump 60 to the hydraulic clutches C2, C3.

The further explanation will be made with reference to FIG. 4. When the oil pump 60 is driven by the engine 30, it pumps up the operating oil in the oil pan 62*a* to be drawn through an oil passage 80*a* and strainer 82 and forwards it from a discharge port 60*a* to a first switching valve 84*a* through an oil passage 80*b* and to first and second electromagnetic solenoid valves (linear solenoid valves) 86*a*, 86*b* through oil passages 80*c*, 80*d*.

The first switching valve 84*a* is connected to a second switching valve 84*b* through an oil passage 80*e*. Each of the valves 84*a*, 84*b* has a movable spool installed therein and the spool is urged by a spring at its one end (left end in the drawing) toward the other end. The valves 84*a*, 84*b* are connected on the sides of the other ends of the spools with the first and second solenoid valves 86*a*, 86*b* through oil passages 80*f*, 80*g*, respectively.

Upon being supplied with current (i.e., made ON), a spool housed in the first solenoid valve 86*a* is displaced to output the hydraulic pressure supplied from the pump 60 through the oil passage 80*c* to the other end side of the spool of the first switching valve 84*a*. Accordingly, the spool of the first switching valve 84*a* is displaced to its one end side, thereby forwarding the operating oil in the oil passage 80*b* to the oil passage 80*e*.

Similarly to the first solenoid valve 86*a*, upon being supplied with current (i.e., made ON), a spool of the second solenoid valve 86*b* is displaced to output the hydraulic pressure supplied from the pump 60 through the oil passage 80*d* to the other end side of the spool of the second switching valve 84*b*. Accordingly, the spool of the second switching valve 84*b* is displaced to its one end side, thereby forwarding the operating oil in the oil passage 80*e* to the second-speed hydraulic clutch C2 through the oil passage 80*h*. In contrast, when the second solenoid valve 86*b* is not supplied with current (made OFF) and no hydraulic pressure is outputted to the other end side of the second switching valve 84*b*, the operating oil in the oil passage 80*e* is forwarded to the third-speed hydraulic clutch C3 through the oil passage 80*i*.

When the first and second solenoid valves 86*a*, 86*b* are both made OFF, the hydraulic pressure is not supplied to the hydraulic clutches C2, C3 and hence, the output first-speed gear 74 and first connecting shaft 58 are interconnected through the first-speed clutch C1 so that the first speed is established.

When the first and second solenoid valves 86*a*, 86*b* are both made ON, the hydraulic pressure is supplied to the second-speed hydraulic clutch C2 and accordingly, the counter second-speed gear 70 and countershaft 56 are interconnected so that the second speed is established. Further, when the first solenoid valve 86*a* is made ON and the second solenoid valve 86*b* is made OFF, the hydraulic pressure is supplied to the third-speed hydraulic clutch C3 and accordingly, the counter third-speed gear 72 and countershaft 56 are interconnected so that the third speed is established.

Thus, one of the gear positions of the transmission 46 is selected (i.e., transmission control is conducted) by controlling ON/OFF of the first and second switching valves 84*a*, 84*b*.

Note that the operating oil (lubricating oil) from the hydraulic pump 60 is also supplied to the lubricated portions (e.g., the shafts 54, 56, 58, etc.) of the transmission 46 through the oil passage 80*b*, an oil passage 80*j*, a regulator valve 88 and a relief valve 90. Also, the first and second switching valves 84*a*, 84*b* and the first and second solenoid valves 86*a*, 86*b* are connected with an oil passage 80*k* adapted to relieve pressure.

The explanation on FIG. 2 is resumed. The shift mechanism 52 comprises a second connecting shaft 52*a* that is connected to the first connecting shaft 58 of the transmission mechanism 50 and installed parallel to the vertical axis to be rotatably supported, a forward bevel gear 52*b* and reverse bevel gear 52*c* that are connected to the second connecting shaft 52*a* to be rotated, a clutch 52*d* that can engage the propeller shaft 44 with either one of the forward bevel gear 52*b* and reverse bevel gear 52*c*, and other components.

The interior of the engine cover 32 is disposed with an electric shift motor (actuator) 92 that drives the shift mechanism 52. The output shaft of the shift motor 92 can be connected via a speed reduction gear mechanism 94 with the upper end of a shift rod 52*e* of the shift mechanism 52. When the shift motor 92 is operated, its output appropriately displaces the shift rod 52*e* and a shift slider 52*f* to move the clutch 52*d* to change the shift position among forward, reverse and neutral positions.

When the shift position is the forward or reverse position, the rotational output of the first connecting shaft 58 is transmitted via the shift mechanism 52 to the propeller shaft 44 to rotate the propeller 42 to generate the thrust in one of the directions making the boat 1 move forward or backward. The outboard motor 10 is equipped with a power source (not shown) such as a battery or the like attached to the engine 30 to supply operating power to the motors 22, 40, 92, etc.

As shown in FIG. 3, a throttle opening sensor 96 is installed near the throttle valve 38 and produces an output or signal indicative of opening of the throttle valve 38, i.e., throttle opening TH. A shift position sensor (reverse position determiner) 100 is installed near the shift motor 92 and produces an output or signal corresponding to the shift position of the transmission 46. A crank angle sensor 102 is installed near the crankshaft of the engine 30 and produces a pulse signal at every predetermined crank angle.

The outputs of the foregoing sensors are sent to an Electronic Control Unit (ECU) 110 disposed in the outboard motor 10. The ECU 110 which has a microcomputer comprising a CPU, ROM, RAM and other devices is installed in the engine cover 32 of the outboard motor 10.

As shown in FIG. 1, a steering wheel 114 is installed near a cockpit (the operator's seat) 112 of the hull 12 to be manipulated or rotated by the operator (not shown). A steering angle sensor 116 attached on a shaft (not shown) of the steering wheel 114 produces an output or signal corresponding to the steering angle applied or inputted by the operator through the steering wheel 114.

A remote control box 120 provided near the cockpit 112 is equipped with a shift/throttle lever (throttle lever) 122 installed to be manipulated by the operator. The lever 122 can be moved or swung in the front-back direction from the initial position. The lever 122 is defined to be in a neutral range when being positioned in the initial position or thereabout, in a forward range when being moved (inclined) forward from the initial position, and in a reverse position when being moved backward therefrom.

The lever 122 is used by the operator to input a forward/reverse change command and an engine speed regulation command (i.e., a desired engine speed NEd) including an acceleration/deceleration command or instruction for the engine 30. The desired engine speed NEd is proportional to a manipulation amount of the lever 122 from the initial position. Specifically, when the manipulation amount is small, the desired engine speed NEd is relatively small and the desired engine speed NEd is increased with increasing manipulation amount (i.e., as the lever 122 is moved away from the initial position). A lever position sensor 124 is installed in the remote control box 120 and produces an output or signal corresponding to a position of the lever 122.

A switch 130 is also provided near the cockpit 112 to be manually operated by the operator to input a fuel consumption decreasing command for decreasing fuel consumption of the engine 30. The switch 130 is manipulated or pressed when the operator desires to travel the boat 1 with high fuel efficiency, and upon the manipulation, it produces a signal (ON signal) indicative of the fuel consumption decreasing command. The outputs of the sensors 116, 124 and switch 130 are also sent to the ECU 110.

The ECU 110 controls the operation of the steering motor 22 based on the inputted outputs, while controlling the operation of the shift motor 92 in response to the output of the lever position sensor 124 to change the shift position of the transmission 46. More precisely, the ECU 110 controls the operation of the motor 92 to change the shift position to the forward position when the lever 122 is in the forward range, to the neutral position when it is in the neutral range, and to the reverse position when it is in the reverse range.

Further, based on the inputted outputs, the ECU 110 performs the transmission control of the transmission 46 (described later), while controlling the operation of the trim unit 24. Furthermore, the ECU 110 counts the pulse signals of the crank angle sensor 102 to detect or calculate the engine speed NE and based on the detected engine speed NE and throttle opening TH, controls the operation of the throttle motor 40 so that the engine speed NE converges to the desired engine speed NEd (which is set in accordance with the position of the lever 122).

Thus, the outboard motor control apparatus according to the embodiment is a Drive-By-Wire type apparatus whose operation system (steering wheel 114, lever 122) has no mechanical connection with the outboard motor 10.

Figure 5:
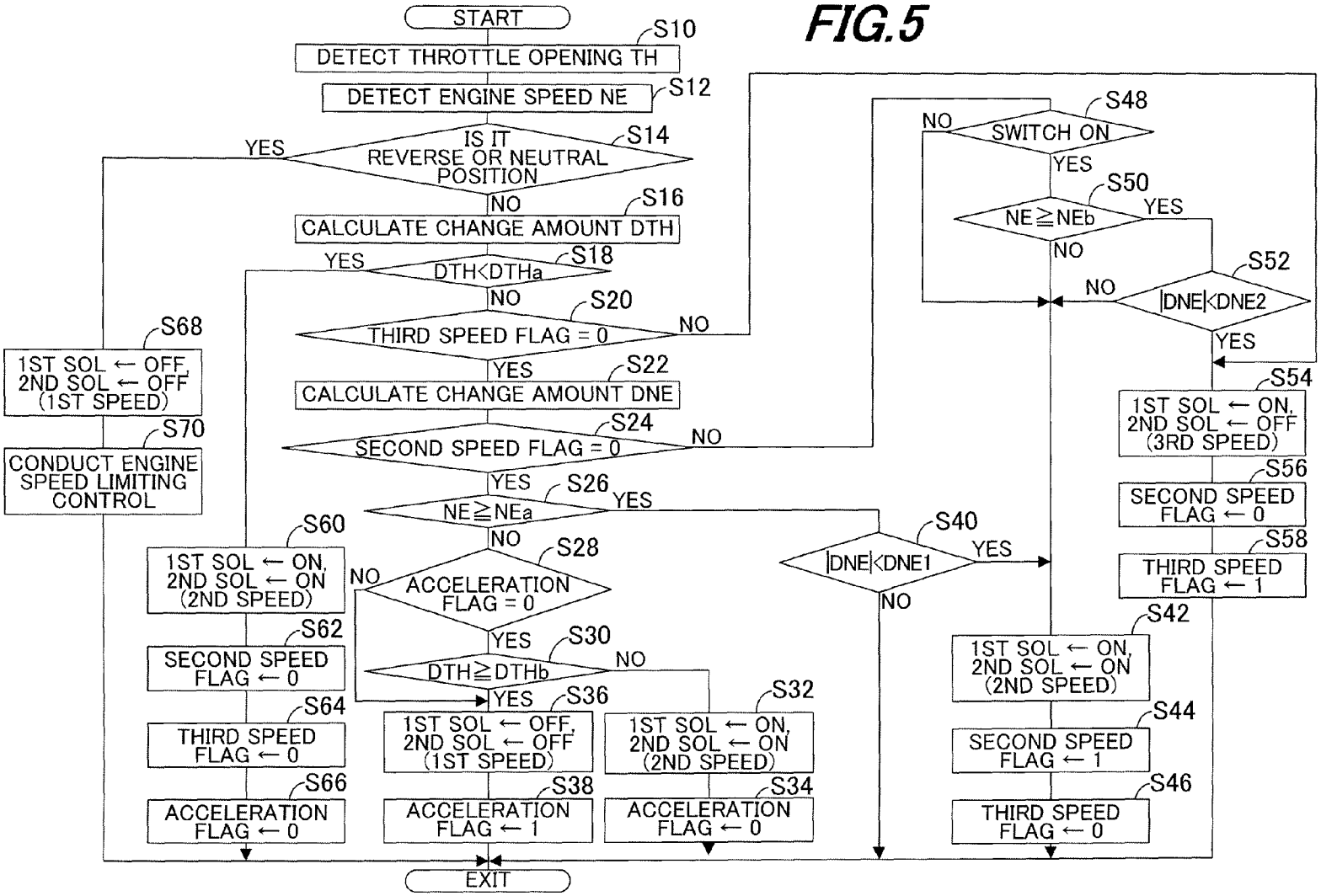
FIG. 5 is a flowchart showing transmission control operation, etc., by an electronic control unit shown in FIG. 1.

FIG. 5 is a flowchart showing the transmission control operation and engine speed control operation by the ECU 110. The illustrated program is executed by the ECU 110 at predetermined intervals, e.g., 100 milliseconds.

The program begins at S10, in which the throttle opening TH is detected or calculated from the output of the throttle opening sensor 96, and proceeds to S12, in which the engine speed NE is detected from the output of the crank angle sensor 102.

Next, the program proceeds to S14, in which it is determined whether the shift position of the transmission 46 is in the reverse or neutral position. This determination is made based on the output of the shift position sensor 100. When the result in S14 is negative, i.e., when the transmission 46 is in the forward position, the program proceeds to S16, in which a change amount (variation) DTH of the detected throttle opening TH per unit time (e.g., 500 milliseconds) is calculated.

The program proceeds to S18, in which it is determined whether the deceleration is instructed to the engine 30 by the operator, i.e., whether the engine 30 is in the operating condition to decelerate the boat 1. This determination is made by checking as to whether the throttle valve 38 is operated in the closing direction. More specifically, when the change amount DTH is less than a deceleration-determining predetermined value DTHa set to a negative value (e.g., −0.5 degree), it is determined that the valve 38 is operated in the closing direction, i.e., the deceleration is instructed.

When the result in S18 is negative, the program proceeds to S20, in which it is determined whether the bit of an after-acceleration third-speed changed flag (hereinafter called the "third speed flag") which indicates that the gear position is changed to the third speed after the acceleration is completed, is 0. Since the initial value of this flag is 0, the result in S20 in the first program loop is generally affirmative and the program proceeds to S22.

In S22, a change amount (variation) DNE of the engine speed NE is calculated. The change amount DNE is obtained by subtracting the engine speed NE detected in the present program loop from that detected in the previous program loop.

The program proceeds to S24, in which it is determined whether the bit of an after-acceleration second-speed changed flag (hereinafter called the "second speed flag") is 0. The bit of this flag is set to 1 when the gear position is changed from the first speed to the second speed after the acceleration is completed, and otherwise, reset to 0 (described later).

Since the initial value of the second speed flag is also 0, the result in S24 in the first program loop is generally affirmative and the program proceeds to S26, in which it is determined whether the engine speed NE is equal to or greater than a second-speed change prescribed speed NEa. The prescribed speed NEa will be explained later.

Since the engine speed NE is less than the prescribed speed NEa generally in a program loop immediately after the engine start, the result in S26 is negative and the program proceeds to S28, in which it is determined whether the bit of an acceleration determining flag (explained later; indicated by "acceleration flag" in the drawing) is 0. Since the initial value of this flag is also 0, the result in S28 in the first program loop is generally affirmative and the program proceeds to S30.

In S30, it is determined whether the acceleration (precisely, the rapid acceleration) is instructed to the engine 30 by the operator, i.e., whether the engine 30 is in the operating condition to accelerate the boat 1 (rapidly). This determination is made by checking as to whether the throttle valve 38 is operated in the opening direction rapidly.

Specifically, the change amount DTH of the throttle opening TH detected in S16 is compared with an acceleration-determining predetermined value DTHb and when the change amount DTH is equal to or greater than the predetermined value DTHb, it is determined that the throttle valve 38 is operated in the opening direction rapidly, i.e., the acceleration is instructed. The acceleration-determining predetermined value DTHb is set to a value (positive value, e.g., 0.5 degree) greater than the deceleration-determining predetermined value DTHa, as a criterion for determining whether the acceleration is instructed to the engine 30.

When the result in S30 is negative, i.e., it is determined that neither the acceleration nor the deceleration is instructed to the engine 30, the program proceeds to S32, in which the first and second solenoid valves 86*a*, 86*b* (indicated by "1ST SOL," "2ND SOL" in the drawing) are both made ON to select the second speed in the transmission 46, and to S34, in which the bit of the acceleration determining flag is reset to 0.

On the other hand, when the result in S30 is affirmative, the program proceeds to S36, in which the first and second solenoid valves 86*a*, 86*b* are both made OFF to change the gear position (shift down the gear) of the transmission 46 from the second speed to the first speed. As a result, the output torque of the engine 30 is amplified through the transmission 46 (more precisely, the transmission mechanism 50) which has been shifted down to the first speed, and transmitted to the propeller 42 via the propeller shaft 44, thereby improving the acceleration performance.

Then the program proceeds to S38, in which the bit of the acceleration determining flag is set to 1. Specifically, the bit of this flag is set to 1 when the change amount DTH is equal to or greater than the predetermined value DTHb and the gear position is changed from the second speed to the first speed, and otherwise, reset to 0. Upon setting of the bit of the acceleration determining flag to 1, the result in S28 in the next and subsequent loops becomes negative and the program skips the process of S30.

Thus, since the gear position is set in the second speed when the shift position of the transmission 46 is in the forward position and it is during a period from when the engine 30 is started until the acceleration is instructed (i.e., during the normal operation), it becomes possible to ensure the usability of the outboard motor 10 similarly to that of an outboard motor having no transmission.

After the transmission 46 is changed to the first speed, when the engine speed NE is gradually increased and the acceleration through the torque amplification in the first speed is completed (i.e., the acceleration range is saturated), the engine speed NE reaches the prescribed speed NEa. Consequently, in the next program loop, the result in S26 becomes affirmative and the program proceeds to S40 onward. The second-speed change prescribed speed NEa is set to a relatively high value (e.g., 6000 rpm) as a criterion for determining whether the acceleration in the first speed is completed.

In S40, it is determined whether the engine speed NE is stable, i.e., the engine 30 is stably operated. This determination is made by comparing an absolute value of the change amount DNE of the engine speed NE with a first prescribed value DNE1. When the absolute value is less than the first prescribed value DNE1, the engine speed NE is determined to be stable. The first prescribed value DNE1 is set as a criterion (e.g., 500 rpm) for determining whether the engine speed NE is stable, i.e., the change amount DNE is relatively small.

When the result in S40 is negative, the program is terminated with the first speed being maintained, and when the result is affirmative, the program proceeds to S42, in which the first and second solenoid valves 86*a*, 86*b* are both made ON to change the transmission 46 (shift up the gear) from the first speed to the second speed. It causes the increase in the rotational speed of the second connecting shaft 52*a* and that of the propeller shaft 44, so that the boat speed reaches the maximum speed (in a range of the engine performance), thereby improving the speed performance.

The program proceeds to S44, in which the bit of the second speed flag is set to 1 and to S46, in which the bit of the third speed flag is reset to 0. Upon setting of the bit of the second speed flag to 1 in S44, the result in S24 in the next and subsequent loops becomes negative and the program proceeds to S48. Thus, when the bit of the second speed flag is set to 1, i.e., when the gear position is changed to the second speed after the acceleration in the first speed is completed, the process of S48 onward is conducted.

In S48, it is determined whether the switch 130 outputs the ON signal, i.e., whether the fuel consumption decreasing command for the engine 30 is inputted by the operator. When the result in S48 is negative, the program proceeds to the aforementioned process of S42 to S46, while, when the result is affirmative, the program proceeds to S50, in which it is determined whether the engine speed NE is equal to or greater than a third-speed change prescribed speed NEb. The third-speed change prescribed speed NEb is set to a value (e.g., 5000 rpm) slightly lower than the second-speed change prescribed speed NEa, as a criterion for determining whether it is possible to change the gear position to the third speed (explained later).

When the result in S50 is affirmative, the program proceeds to S52, in which, similarly to S40, it is determined whether the engine speed NE is stable. Specifically, the absolute value of the change amount DNE of the engine speed NE is compared with a second prescribed value DNE2 and when it is less than the second prescribed value DNE2, the engine speed NE is determined to be stable. The second prescribed value DNE2 is set as a criterion (e.g., 500 rpm) for determining whether the change amount DNE is relatively small and the engine speed NE is stable.

When the result in S52 or S50 is negative, the program proceeds to S42 and when the result in S52 is affirmative, the program proceeds to S54, in which the first solenoid valve 86*a* is made ON and the second solenoid valve 86*b* is made OFF to change the transmission 46 (shift up the gear) from the second speed to the third speed. As a result, the engine speed NE is decreased, thereby decreasing the fuel consumption, i.e., improving the fuel efficiency.

Next, the program proceeds to S56, in which the bit of the second speed flag is reset to 0, and to S58, in which the bit of the third speed flag is set to 1. Thus, the third speed flag is set to 1 when the gear position is changed from the second speed to the third speed after the acceleration is completed, and otherwise, reset to 0. Note that, in a program loop after the bit of the third speed flag is set to 1, the result in S20 is negative and the process of S54 to S58 is conducted, whereafter the program is terminated with the third speed being maintained.

When the result in S18 is affirmative, i.e., when the change amount DTH is less than the predetermined value DTHa, the program proceeds to S60, in which the first and second solenoid valves 86*a*, 86*b* are both made ON to change the gear position to the second speed. Then the program proceeds to S62, S64 and S66, in which all the bits of the second speed flag, third speed flag and acceleration determining flag are reset to 0.

When the lever 122 is manipulated by the operator to be positioned in the reverse or neutral range so that the shift position of the transmission 46 is changed to the reverse or neutral position, the result in S14 becomes affirmative and the program proceeds to S68, in which the first and second solenoid valves 86*a*, 86*b* are both made OFF to change the gear position of the transmission 46 from the second speed to the first speed. As a result, in the case where the shift position of the transmission 46 is in the reverse position, the rotational speed of the propeller 42 is decreased.

Then the program proceeds to S70, in which engine speed limiting control for limiting the engine speed NE to a value at or below a predetermined speed NEd1 is conducted. More exactly, in this control, the engine speed NE is limited by limiting the upper limit value of the desired engine speed NEd to the predetermined speed NEd1. The predetermined speed NEd1 is set to a value which enables the engine 30 to avoid rotating at high speed (i.e., to a value representing the medium speed of lower than the high speed; e.g., 3500 rpm).

As a result, even when the lever 122 is greatly moved from the initial position to the backward and inclined to the back end (edge) of the remote control box 120, the engine speed NE is controlled to be equal to or less than the predetermined speed NEd1. This control is implemented by controlling the operation of the throttle motor 40 to regulate the throttle opening TH. Owing to the above configuration, it becomes possible to prevent the engine speed NE from exceeding the predetermined speed NEd1, i.e., prevent the engine 30 from rotating at high speed, when the boat 1 is traveled backward.

Figure 6:
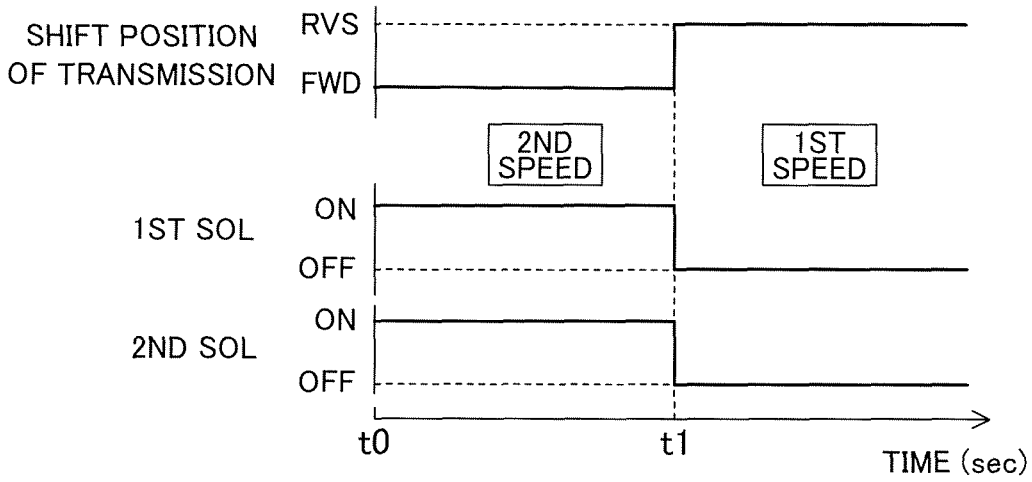
FIG. 6 is a time chart for explaining the operation of the FIG. 5 flowchart.

FIG. 6 is a time chart for explaining a part of the above operation.

As shown in FIG. 6, from the time t0 to t1, when the shift position of the transmission 46 is in the forward position and the normal operation other than rapid acceleration is conducted, the gear position of the transmission 46 is changed to the second speed (S32). At the time t1, when the lever 122 is manipulated by the operator to change the shift position from the forward position to the reverse position (affirmative result in S14), the gear position is changed from the second speed to the first speed (S68). The engine speed NE when the transmission 46 is in the reverse position is controlled (limited) to be equal to or less than the predetermined speed NEd1 (S70).

As stated above, the embodiment is configured to have an apparatus and a method for controlling operation of an outboard motor 10 adapted to be mounted on a stern 12*a* of a boat 1 and having an internal combustion engine 30 to power a propeller 42 through a drive shaft and a propeller shaft, and a transmission 46 that is installed at a location between the drive shaft (input shaft) 54 and the propeller shaft 44, the transmission 46 being selectively changeable in gear position to establish speeds including at least a first speed and a second speed and transmitting power of the engine to the propeller with a gear ratio determined by established speed, comprising: a reverse position determiner (shift position sensor 100, ECU 110, S14) adapted to determine whether the transmission 46 is in a reverse position; and a transmission controller (ECU 110, S68) adapted to control operation of the transmission 46 to change the gear position from the second speed to the first speed when the second speed is selected and it is determined that the transmission is in the reverse position.

With this, it becomes possible to decrease the rotational speed of the propeller 42 when the boat 1 is traveled backward, so that the propeller 42 can be efficiently rotated, i.e., the efficiency of the propeller 42 is not degraded, thereby preventing the thrust of the boat 1 from decreasing. Since the decrease in the thrust can be prevented, it becomes possible to improve the operability of the boat 1 when the boat 1 is traveled backward and stopped.

The apparatus and method further include an engine speed controller (electric throttle motor 40, ECU 110, S70) adapted to control speed NE of the engine to be equal to or less than a predetermined speed NEd1 when it is determined that the transmission is in the reverse position.

With this, it becomes possible to set the predetermined speed NEd1 to a value which enables the engine 30 to avoid rotating at high speed (i.e., to a value representing the medium speed of lower than the high speed; e.g., 3500 rpm) and limit the engine speed NE so as not to exceed the predetermined speed NEd1. Therefore, the rotational speed of the propeller 42 when the boat 1 is traveled backward can be efficiently decreased, thereby reliably preventing the thrust of the boat 1 from decreasing.

In the apparatus and method, the predetermined speed is set to be a medium speed of the engine 30.

It should be noted that, although the outboard motor is exemplified above, this invention can be applied to an inboard/outboard motor equipped with a transmission.

It should also be noted that, although the throttle opening TH is regulated to control the engine speed NE to be equal to or less than the predetermined speed NEd1, the ignition cut or fuel cut can instead be utilized for that purpose.

It should also be noted that, although the deceleration/acceleration-determining predetermined values DTHa, DTHb, predetermined speed NEd1, displacement of the engine 30 and other values are indicated with specific values in the foregoing, they are only examples and not limited thereto.

Japanese Patent Application No. 2010-123287, filed on May 28, 2010 is incorporated by reference herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. A controlling apparatus in combination with an outboard motor;

said outboard motor comprising an internal combustion engine to power a propeller through a drive shaft and a propeller shaft, and a transmission that is installed at a location between the drive shaft and the propeller shaft, the transmission being selectively changeable in gear position to establish speed gears including at least a first speed gear which is a low speed gear and a second speed gear which is a high speed gear and transmitting power of the engine to the propeller with a gear ratio determined by established speed gear, said controlling apparatus comprising:

a reverse position determiner adapted to determine whether the transmission is in a reverse position; and a transmission controller adapted to control operation of the transmission to change the gear position from the second speed gear to the first speed gear when the second speed gear is selected and it is determined that the transmission is in the reverse position;

wherein the gear ratio of the first speed gear is set to be higher than the gear ratio of the second speed gear; and when it is determined that the transmission is in the reverse position, an engine speed controller controls speed of the engine by one of controlling a throttle opening, applying an ignition cut and applying a fuel cut.

2. The apparatus according to claim 1 wherein said engine speed controller adapted to control speed of the engine to be equal to or less than a predetermined speed when it is determined that the transmission is in the reverse position.

3. The apparatus according to claim 2, wherein the predetermined speed is set to be a medium speed of the engine.

4. A method for controlling operation of an outboard motor, comprising the steps of;

said outboard motor having an internal combustion engine to power a propeller through a drive shaft and a propeller shaft, a transmission that is installed at a location between the drive shaft and the propeller shaft, the transmission being selectively changeable in gear position to establish speedgears including at least a first speed gear which is a low speed gear and a second speed gear which is a high speed gear and transmitting power of the engine to the propeller with a gear ratio determined by established speed gear;

determining whether the transmission is in a reverse position; and controlling operation of the transmission to change the gear position from the second speed gear to the first speed gear when the second speed gear is selected and it is determined that the transmission is in the reverse position;

wherein the gear ratio of the first speed gear is set to be higher than the gear ratio of the second speed gear; and wherein when it is determined that the transmission is in the reverse position, an engine speed controller controls speed of the engine by one of controlling a throttle opening, applying an ignition cut and applying a fuel cut.

5. The method according to claim 4, further including the step of:

controlling speed of the engine to be equal to or less than a predetermined speed when it is determined that the transmission is in the reverse position.

6. The method according to claim 5, wherein the predetermined speed is set to be a medium speed of the engine.

7. The apparatus according to claim 3, wherein the medium speed is less than 3500 rpm.

8. The method according to claim 6, wherein the medium speed is less than 3500 rpm.

* * * * *